US012256774B2

(12) United States Patent
Gindrat

(10) Patent No.: US 12,256,774 B2
(45) **Date of Patent: *Mar. 25, 2025**

(54) RODS FOR USE IN SMOKING ARTICLES

(71) Applicant: Philip Morris Products S.A., Neuchatel (CH)

(72) Inventor: Pierre-Yves Gindrat, Saxon (CH)

(73) Assignee: Philip Morris Products S.A., Neuchatel (CH)

( * ) Notice: Subject to any disclaimer, the term of this patent is extended or adjusted under 35 U.S.C. 154(b) by 311 days.

This patent is subject to a terminal disclaimer.

(21) Appl. No.: 17/591,240

(22) Filed: Feb. 2, 2022

(65) Prior Publication Data

US 2022/0151286 A1 May 19, 2022

Related U.S. Application Data

(63) Continuation of application No. 16/841,451, filed on Apr. 6, 2020, now Pat. No. 11,272,732, which is a (Continued)

(30) Foreign Application Priority Data

May 31, 2011 (EP) ..... 11250571

(51) Int. Cl.
*A24D 1/20* (2020.01)
*A24B 3/14* (2006.01)
(Continued)

(52) U.S. Cl.
CPC ..... *A24D 1/20* (2020.01); *A24B 3/14* (2013.01); *A24B 15/12* (2013.01); *A24B 15/16* (2013.01);
(Continued)

(58) Field of Classification Search
CPC ..... A24D 1/20; A24B 3/14
See application file for complete search history.

(56) References Cited

U.S. PATENT DOCUMENTS 439,031 A 10/1890 Dyke
2,883,990 A 4/1959 Nichols
(Continued)

FOREIGN PATENT DOCUMENTS

CH 691 156 A5 5/2001
CN 85 1 06273 A 2/1987
(Continued)

OTHER PUBLICATIONS

"Readers Plus (Epwing CD-ROM Version) Kenkyusha Printing Co. Ltd" 1996, 1 page.
(Continued)

*Primary Examiner* — Eric Yaary
(74) *Attorney, Agent, or Firm* — Oblon, McClelland, Maier & Neustadt, L.L.P.

(57) ABSTRACT

A smoking article is provided, including an aerosol-generating substrate, the aerosol-generating substrate being a rod including a gathered sheet of homogenised tobacco material circumscribed by a wrapper, the gathered sheet of homogenised tobacco material including one or more aerosol-formers and having an aerosol-former content of greater than 5% on a dry weight basis, and the rod having a length of between 5 mm and 20 mm.

14 Claims, 2 Drawing Sheets

Related U.S. Application Data continuation of application No. 15/900,468, filed on Feb. 20, 2018, now Pat. No. 10,624,385, which is a continuation of application No. 14/123,166, filed as application No. PCT/EP2012/060230 on May 31, 2012, now Pat. No. 9,930,910.

(51) Int. Cl.

| | |
|---|---|
| ***A24B 15/12*** | (2006.01) |
| ***A24B 15/16*** | (2020.01) |
| ***A24B 15/30*** | (2006.01) |
| ***A24C 5/18*** | (2006.01) |
| ***A24D 1/00*** | (2020.01) |
| ***A24D 1/22*** | (2020.01) |
| ***A24F 40/20*** | (2020.01) |

(52) U.S. Cl.

CPC ..... *A24B 15/165* (2013.01); *A24B 15/30* (2013.01); *A24C 5/18* (2013.01); *A24D 1/002* (2013.01); *A24D 1/22* (2020.01); *A24F 40/20* (2020.01)

(56) References Cited

U.S. PATENT DOCUMENTS

| | | | |
|---|---|---|---|
| 3,084,697 | A | 4/1963 | Eissmann |
| 3,299,895 | A | 1/1967 | Dearsley |
| 3,472,236 | A | 10/1969 | Dearsley |
| 3,584,631 | A | 6/1971 | Halter |
| 3,860,012 | A | 1/1975 | Selke |
| 3,860,021 | A | 1/1975 | Saric |
| 3,894,544 | A | 7/1975 | Egri |
| 4,000,748 | A | 1/1977 | Summers |
| 4,168,712 | A | 9/1979 | Labbe |
| 4,281,671 | A | 8/1981 | Bynre et al. |
| 4,291,711 | A | 9/1981 | Berger |
| 4,355,995 | A | 10/1982 | Berger |
| 4,598,721 | A | 7/1986 | Stiller et al. |
| 4,787,402 | A | 11/1988 | Leonard |
| 4,807,809 | A | 2/1989 | Pryor et al. |
| 4,821,749 | A | 4/1989 | Toft et al. |
| 4,889,143 | A | 12/1989 | Pryor et al. |
| 4,903,714 | A | 2/1990 | Barnes et al. |
| 5,016,656 | A | 5/1991 | McMurtie |
| 5,027,837 | A | 7/1991 | Clearman et al. |
| 5,203,355 | A | 4/1993 | Clearman et al. |
| 5,348,027 | A | 9/1994 | Barnes et al. |
| 5,415,186 | A | 5/1995 | Casey, III et al. |
| 5,469,871 | A | 11/1995 | Barnes et al. |
| 5,632,287 | A | 5/1997 | Hayworth et al. |
| 5,709,227 | A | 1/1998 | Arzonico et al. |
| 5,724,998 | A | 3/1998 | Gellaty et al. |
| 5,891,751 | A | 4/1999 | Kurtz et al. |
| 5,988,176 | A | 11/1999 | Baggett, Jr. et al. |
| 6,378,528 | B1 | 4/2002 | Beeson et al. |
| 6,701,935 | B1 | 3/2004 | Oliver |
| 7,074,170 | B2 | 7/2006 | Lanier, Jr. et al. |
| 2002/0129826 | A1 | 9/2002 | Nakanishi et al. |
| 2003/0029466 | A1 | 2/2003 | Oliver |
| 2004/0149298 | A1 | 8/2004 | Moffitt |
| 2004/0177857 | A1 | 9/2004 | Nakanishi et al. |
| 2005/0016549 | A1 | 1/2005 | Banerjee et al. |
| 2005/0056294 | A1 | 3/2005 | Wanna et al. |
| 2005/0066986 | A1 | 3/2005 | Nestor |
| 2005/0072438 | A1 | 4/2005 | Darwish |
| 2007/0023056 | A1 | 2/2007 | Cantrell et al. |
| 2008/0092912 | A1 | 4/2008 | Robinson et al. |
| 2008/0216854 | A1 | 9/2008 | Nicholls et al. |
| 2008/0295853 | A1 | 12/2008 | Jones |
| 2009/0065011 | A1 | 3/2009 | Maeder |
| 2009/0301503 | A1 | 12/2009 | Peter |
| 2010/0200006 | A1 | 8/2010 | Robinson et al. |
| 2010/0300463 | A1 | 12/2010 | Chen et al. |
| 2011/0036364 | A1 | 2/2011 | Pienemann et al. |
| 2011/0126848 | A1 | 6/2011 | Zuber |
| 2012/0042885 | A1* | 2/2012 | Stone ..... A24D 1/22 131/194 |
| 2012/0060853 | A1 | 3/2012 | Robinson et al. |
| 2017/0181466 | A1 | 6/2017 | Batista |

FOREIGN PATENT DOCUMENTS

| | | | |
|---|---|---|---|
| CN | 1072576 | A | 6/1993 |
| CN | 1306401 | A | 8/2001 |
| CN | 101076263 | A | 11/2007 |
| CN | 101557728 | A | 10/2009 |
| CN | 101631478 | A | 1/2010 |
| CN | 101778577 | A | 7/2010 |
| CN | 101877975 | A | 11/2010 |
| CN | 201700388 | U | 1/2011 |
| CN | 102068035 | A | 2/2011 |
| CN | 102048236 | A | 5/2011 |
| CN | 201813826 | U | 5/2011 |
| EP | 0 304 759 | | 3/1989 |
| EP | 0 342 538 | A2 | 11/1989 |
| EP | 0 444 553 | A2 | 9/1991 |
| EP | 0 545 186 | A2 | 6/1993 |
| EP | 0 565 359 | A1 | 10/1993 |
| EP | 0 565 360 | A2 | 10/1993 |
| EP | 0 569 964 | A2 | 11/1993 |
| EP | 0 589 298 | A1 | 3/1994 |
| EP | 0 777 977 | | 6/1997 |
| EP | 0 822 760 | B1 | 6/2003 |
| EP | 0 822 670 | B1 | 11/2005 |
| EP | 2 062 484 | | 5/2009 |
| EP | 1 889 550 | B1 | 7/2009 |
| EP | 2 083 643 | A | 8/2009 |
| EP | 1 909 604 | B1 | 12/2009 |
| EP | 2 412 255 | A1 | 3/2010 |
| EP | 2 361 516 | A1 | 8/2011 |
| EP | 2 173 204 | B1 | 10/2013 |
| GB | 983928 | A | 2/1965 |
| GB | 1 197 174 | | 7/1970 |
| GB | 1 509 018 | A | 4/1978 |
| GB | 2 027 580 | A | 2/1980 |
| GB | 2 070 409 | | 9/1981 |
| JP | 46-16157 | A | 5/1971 |
| JP | 61-37906 | B2 | 8/1986 |
| JP | 64-1114 | B2 | 1/1989 |
| JP | 1-243979 | A | 9/1989 |
| JP | 2-53476 | A | 2/1990 |
| JP | 5-103836 | A | 4/1993 |
| JP | 6-30752 | A | 2/1994 |
| JP | 6-46817 | A | 2/1994 |
| JP | 6-189733 | A | 7/1994 |
| JP | 8-504598 | A | 5/1996 |
| JP | 10-75760 | A | 3/1998 |
| JP | 2007-259864 | A | 10/2007 |
| JP | 3996188 | B2 | 10/2007 |
| JP | 2008-509703 | A | 4/2008 |
| JP | 2009-502194 | A | 1/2009 |
| JP | 2009-504165 | A | 2/2009 |
| JP | 2009-529871 | A | 8/2009 |
| JP | 2010-506594 | A | 3/2010 |
| JP | 2010-520764 | A | 6/2010 |
| JP | 2010-178730 | A | 8/2010 |
| JP | 2010-535530 | A | 11/2010 |
| JP | 5292461 | B2 | 9/2013 |
| KR | 10-0288602 | B | 2/2001 |
| KR | 10-0449444 | B | 9/2004 |
| TW | 200946041 | A1 | 11/2009 |
| TW | 201043157 | A | 12/2010 |
| WO | 81/00001 | A1 | 1/1981 |
| WO | 94/24892 | A1 | 11/1994 |
| WO | 96/32854 | A2 | 10/1996 |
| WO | 00/08958 | A1 | 2/2000 |
| WO | 00 089958 | | 2/2000 |
| WO | 00/074503 | A1 | 12/2000 |
| WO | 01/70054 | A1 | 9/2001 |
| WO | 2006 014995 | | 2/2006 |
| WO | 2007/046005 | A2 | 4/2007 |
| WO | 2007/108877 | A2 | 9/2007 |
| WO | 2008/108889 | A1 | 9/2008 |

(56) References Cited

FOREIGN PATENT DOCUMENTS

| | | | |
|---|---|---|---|
| WO | 2008/110931 | A2 | 9/2008 |
| WO | 2008/110932 | A2 | 9/2008 |
| WO | 2009/022232 | A3 | 2/2009 |
| WO | 2009/048522 | A1 | 4/2009 |
| WO | 2009/065459 | A1 | 5/2009 |
| WO | 2009/082331 | A1 | 7/2009 |
| WO | 2009/087215 | A2 | 7/2009 |
| WO | 2010/110227 | A1 | 9/2010 |
| WO | 2010/113702 | A1 | 10/2010 |
| WO | 2016/023965 | A1 | 2/2016 |

OTHER PUBLICATIONS

English translation of Chinese Office Action issued Application No. 201280026033.2 dated Aug. 3, 2015 (9 pages).
European Notice of Opposition dated Feb. 3, 2017, including Statement of Grounds for Opposition, filed in counterpart European Application No. 12730817.9, (58 pages).
Office Action issued Apr. 8, 2016 in Korean Patent Application No. 10-2013-7030332 (submitting English translation only).
Combined Chinese Office Action and Search Report issued Apr. 12, 2016 in Patent Application No. 201280026033.2 (submitting English translation only).
Extended European Search Report issued Oct. 31, 2011 in Patent Application No. 11250571.4.
Singaporean Office Action issued Sep. 19, 2017 in Patent Application No. 2013086871.
Office Action issued Mar. 2, 2016 in Japanese Patent Application No. 2014-513188 (submitting English translation only).
International Search Report Issued Jan. 4, 2013 in PCT/EP12/060230 Filed May 31, 2012.
Written Opinion Issued Jan. 4, 2013 in PCT/EP12/060230 Filed May 31, 2012.
Combined Chinese Office Action and Search Report issued on Mar. 22, 2018 in Patent Application No. 201710593167.7 (Submitting English translation only), 11 pages.
Chinese Office Action issued on Mar. 23, 2018 in Patent Application No. 201280026033.2 (Submitting English translation only), 6 pages Additional References sheet(s) attached.
Office Action issued May 1, 2018 in Japanese Patent Application No. 2016-189320 (submitting English language translation only), 4 pages.
Office Action issued Dec. 25, 2018 in Chinese Patent Application No. 201280026033.2.
Office Action issued Jun. 25, 2019 in Israeli Patent Application No. 255923, with English translation.
Japanese Office Action issued on Feb. 21, 2019 in Patent Application No. 2016-189320 (with English translation), 7 pages sheet(s) attached.
"Major Processes in the Manufacture of Sheet Tobacco" Tobacco Encyclopedia, Tobacco Journal International, 1984, pp. 389-390 and cover pages.
G. Patskan, et al., "Toxicological Evaluation of an Electrically Heated Cigarette. Part 1: Overview of Technical Concepts and Summary of Findings" Journal of Applied Toxicology, vol. 23, 2003, pp. 323-328.
R. Stabbert, et al., "Toxicological Evaluation of an Electrically Heated Cigarette. Part 2: Chemical Composition of Mainstream Smoke" Journal of Applied Toxicology, vol. 23, 2003, pp. 329-339.
"Slurry-Processed Sheet Tobacco" Tobacco Dictionary, 1st Edition, Mar. 31, 2009, p. 401 (with English translation).
Dr. Nicolas Baskevitch, "Reconstituted Tobacco" World Tobacco, 1986-1987 pp. 12-21 and cover pages.
Office Action issued Aug. 28, 2019, in Korea Patent Application No. 2019-7018024 (w/English translation), 14 pages.
Office Action issued Jul. 20, 2020 in corresponding European Patent Application No. 18 181 551.5, 4 pages.
Japanese Office Action issued on Aug. 20, 2020 in Patent Application No. 2019-115244 (with English translation), 6 pages Additional References sheet(s) attached.
Japanese Office Action issued on Aug. 20, 2020 in Patent Application No. 2019-115244 (with English translation), 6 pages.
Combined Chinese Office Action and Search Report issued Mar. 3, 2021 in Patent Application No. 201910241343.X (with English language translation), 22 pages.

* cited by examiner

RODS FOR USE IN SMOKING ARTICLES

CROSS REFERENCE TO RELATED APPLICATIONS

This application is a continuation of and claims benefit under 35 U.S.C. § 120 to U.S. patent application Ser. No. 16/841,451, filed Apr. 6, 2020, which is a continuation of and claims benefit under 35 U.S.C. § 120 to U.S. patent application Ser. No. 15/900,468, filed Feb. 20, 2018 (now U.S. Pat. No. 10,624,385), which is a continuation of and claims benefit under 35 U.S.C. § 120 to U.S. patent application Ser. No. 14/123,166, filed Feb. 20, 2014 (now U.S. Pat. No. 9,930,910), which is a U.S. national stage application of PCT/EP2012/060230, filed May 31, 2012, and claims the benefit of claims benefit of priority under 35 U.S.C. § 119 to EP 11250571.4 filed May 31, 2011, the entire contents of each of which are incorporated herein by reference.

The present invention relates to rods comprising a gathered sheet of homogenised tobacco material for use in smoking articles, smoking articles comprising such rods and methods for forming such rods.

Processes and apparatus for producing shreds, strands or strips of tobacco material are known in the art. Typically, the width of such shreds, stands and strips of tobacco material is about 3 mm or less.

For example, U.S. Pat. No. 4,000,748 discloses a process and apparatus for shredding a sheet of reconstituted tobacco into strips and crimping the resultant strips in a substantially simultaneous operation. The sheet of tobacco material is moved between a pair of rotating and intermeshing stacks of disks which shred the sheet into a plurality of strips about 0.65 to 1.55 mm in width. The forward motion of the resultant strips is retarded by engagement with facing surfaces of neighbouring disks causing a buckling of the strips into a crimped configuration. The crimped strips are reported to provide an increase in fill value.

U.S. Pat. No. 4,598,721 discloses a method and apparatus for producing crimped fibre pieces of reconstituted tobacco. Tobacco dust and/or tobacco waste is processed with binders and possibly additives to a plastifiable mixture that is extruded through a special die head to obtain individual filiform crimped intermediate products, which are then separated into individual crimped fibre pieces. The crimped fibre pieces should have a thickness of 0.1 to 0.3 mm, a width of 0.4 to 3 mm and a stretched length of 5 to 40 mm.

U.S. Pat. No. 4,889,143 discloses cigarette rods having a plurality of substantially longitudinally extending strands provided from shredded sheet-like reconstituted tobacco material which are contained in a circumscribing wrapping material. Strips of sheet-like reconstituted tobacco material are shredded into a plurality of strands which are gathered into a rod-like shape and circumscribed by a paper wrap in order to form a continuous rod. The continuous rod is then severed at regular intervals to provide a plurality of rods of the desired length. To control the pressure drop of the cigarette rod, strands having a crimped character may be produced and positioned in a longitudinally extending manner such that air can flow longitudinally through the rod in the spaces between the strands. Strands travelling through the rod-forming means at a slightly lesser speed than that speed at which the strands leave the shredding means can tend to provide crimped strands, that is somewhat bent, wrinkled, wavy or sinusoidal shaped strands, capable of providing increased quantity of material per unit length of rod section.

The formation of rods for smoking articles comprising crimped or uncrimped shreds of tobacco material suffers from a number of disadvantages including those discussed below.

Firstly, shredding tobacco material undesirably generates tobacco fines and other waste.

Secondly, rods comprising shreds of tobacco material exhibit 'loose ends', that is the loss of shreds of tobacco material from the ends of the rod. This is exacerbated by breakage of the shreds of tobacco material during rod formation. Loose ends are not only aesthetically undesirable, but can also disadvantageously lead to the need for more frequent cleaning of manufacturing equipment and smoking devices.

Thirdly, rods comprising shreds of tobacco material exhibit high weight standard deviations, that is rods of the same dimensions tend to be of inconsistent weight. This is due in part to the tendency of the rods to exhibit loose ends as mentioned above. The high weight standard deviation of rods comprising shreds of tobacco material leads to an undesirably high rejection rate of rods whose weight falls outside of a selected acceptance range.

Finally, rods comprising shreds of tobacco material exhibit non-uniform densities, that is, the density along the length of the rod tends to be inconsistent. This is due to variations in the quantity of tobacco material at different locations along the rod, which results in 'voids', that is reduced quantities of tobacco material, and 'pads', that is increased levels of tobacco material. The non-uniform density of rods comprising shreds of tobacco material can undesirably affect the resistance to draw (RTD) of the rods. In addition, the non-uniform density of rods comprising shreds of tobacco material can lead to loose ends when a void is located at the end of the rod.

Loose ends, high weight standard deviations and non-uniform densities as exhibited by rods comprising shreds of tobacco material are particularly problematic and undesirable in rods of short length. Rods of short length are sometimes referred to as plugs.

It would be desirable to provide rods comprising tobacco material for use in smoking articles that exhibit fewer loose ends than rods comprising shreds of tobacco material.

Alternatively or in addition, it would be desirable to provide rods comprising tobacco material for use in smoking articles that exhibit lower weight standard deviations than rods comprising shreds of tobacco material.

Alternatively or in addition, it would be desirable to provide rods comprising tobacco material for use in smoking articles that exhibit more uniform densities than rods comprising shreds of tobacco material.

According to the invention, there is provided a rod comprising a gathered sheet of homogenised tobacco material comprising one or more aerosol-formers circumscribed by a wrapper, wherein the sheet of homogenised tobacco material has an aerosol former content of greater than 5% on a dry weight basis.

According to the invention, there is further provided a rod comprising a gathered sheet of homogenised tobacco material comprising one or more aerosol-formers circumscribed by a wrapper, wherein the sheet of homogenised tobacco material has an aerosol former content of between 5% and 30% by weight on a dry weight basis.

According to the invention, there is further provided a rod comprising a gathered sheet of homogenised tobacco material circumscribed by a wrapper and a continuous element to which one or more additives have been applied, wherein the continuous element is incorporated into the gathered continuous sheet of homogenised tobacco material.

According to the invention, there is further provided a heated smoking article comprising an aerosol-generating substrate, wherein the aerosol-generating substrate comprises a rod comprising a gathered sheet of homogenised tobacco material circumscribed by a wrapper.

As used herein, the term 'rod' is used to denote a generally cylindrical element of substantially circular, oval or elliptical cross-section.

As used herein, the term 'sheet' denotes a laminar element having a width and length substantially greater than the thickness thereof.

As used herein, the term 'length' denotes the dimension in the direction of the cylindrical axis of rods according to the invention.

As used herein, the term 'width' denotes a dimension in a direction substantially perpendicular to the cylindrical axis of rods according to the invention.

As used herein, the term 'homogenised tobacco material' denotes a material formed by agglomerating particulate tobacco.

As used herein, the term 'gathered' denotes that the sheet of homogenised tobacco material is convoluted, folded, or otherwise compressed or constricted substantially transversely to the cylindrical axis of the rod.

As used herein, the expression 'rods according to the invention' also refers to rods in heated smoking articles according to the invention.

It will be appreciated that in the following description of the invention features described in relation to one embodiment of the invention may also be applicable to other embodiments of the invention.

The gathered sheet of homogenised tobacco material preferably extends along substantially the entire length of the rod and across substantially the entire transverse cross-sectional area of the rod.

The inclusion of a gathered sheet of homogenised tobacco material in rods according to the invention advantageously significantly reduces the risk of loose ends compared to rods comprising shreds of tobacco material.

Rods comprising a sheet of homogenised tobacco material according to the invention advantageously exhibit significantly lower weight standard deviations than rods comprising shreds of tobacco material. The weight of a rod according to the invention of a particular length is determined by the density, width and thickness of the sheet of homogenised tobacco material that is gathered to form the rod. The weight of rods according to the invention of a particular length can thus be regulated by controlling the density and dimensions of the sheet of homogenised tobacco material. This reduces inconsistencies in weight between rods according to the invention of the same dimensions, and so results in lower rejection rate of rods whose weight falls outside of a selected acceptance range.

Rods comprising a sheet of homogenised tobacco material according to the invention advantageously exhibit more uniform densities than rods comprising shreds of tobacco material.

In preferred embodiments, rods according to the invention comprise a gathered textured sheet of homogenised tobacco material circumscribed by a wrapper.

Use of a textured sheet of homogenised tobacco material may advantageously facilitate gathering of the sheet of homogenised tobacco material to form a rod according to the invention.

As used herein, the term 'textured sheet' denotes a sheet that has been crimped, embossed, debossed, perforated or otherwise deformed. Textured sheets of homogenised tobacco material for use in the invention may comprise a plurality of spaced-apart indentations, protrusions, perforations or a combination thereof.

In particularly preferred embodiments, rods according to the invention comprise a gathered crimped sheet of homogenised tobacco material circumscribed by a wrapper.

As used herein, the term 'crimped sheet' is intended to be synonymous with the term 'creped sheet' and denotes a sheet having a plurality of substantially parallel ridges or corrugations. Preferably, the crimped sheet of homogenised tobacco material has a plurality of ridges or corrugations substantially parallel to the cylindrical axis of the rod according to the invention. This advantageously facilitates gathering of the crimped sheet of homogenised tobacco material to form the rod. However, it will be appreciated that crimped sheets of homogenised tobacco material for use in the invention may alternatively or in addition have a plurality of substantially parallel ridges or corrugations disposed at an acute or obtuse angle to the cylindrical axis of the rod.

In certain embodiments, sheets of homogenised tobacco material for use in the invention may be substantially evenly textured over substantially their entire surface. For example, crimped sheets of homogenised tobacco material for use in the invention may comprise a plurality of substantially parallel ridges or corrugations that are substantially evenly spaced-apart across the width of the sheet.

According to the invention there is further provided use of a rod according to the invention in a smoking article.

According to the invention there is also provided a smoking article comprising a rod according to the invention.

Rods according to the invention may be used as rods of combustible smokable material in lit-end smoking articles.

In one embodiment, rods according to the invention may be used as rods of combustible smokable material in lit-end cigarettes comprising a rod of combustible smokable material and a filter downstream of the rod of combustible smokable material.

As used herein, the terms 'upstream' and 'downstream' are used to describe the relative positions of components, or portions of components, of smoking articles comprising rods according to the invention in relation to the direction of air drawn through the smoking articles during use thereof.

A number of smoking articles in which tobacco is heated rather than combusted have been proposed in the art. Typically in heated smoking articles, an aerosol is generated by the transfer of heat from a heat source, for example a chemical, electrical or combustible heat source, to a physically separate aerosol-generating substrate, which may be located within, around or downstream of the heat source.

According to the invention there is also provided an aerosol-generating substrate for a heated smoking article, wherein the aerosol-generating substrate comprises a rod according to the invention.

As used herein, the term 'aerosol-generating substrate' denotes a substrate capable of releasing volatile compounds upon heating to generate an aerosol.

Rods according to the invention are particularly suited for use as aerosol-generating substrates in heated smoking articles. Aerosol-generating substrates in heated smoking articles are typically significantly shorter in length than rods of combustible smokable material in conventional lit end smoking articles. As noted above, loose ends, high weight standard deviations and non-uniform densities as exhibited by rods comprising shreds of tobacco material are particularly undesirable in rods of short length. Use of short rods according to the invention as aerosol-generating substrates in heated smoking articles advantageously minimises or avoids one or more of the disadvantages associated with the use of short rods comprising shreds of tobacco material previously discussed above.

According to the invention there is also provided a heated smoking article comprising an aerosol-generating substrate, wherein the aerosol-generating substrate comprises a rod according to the invention.

In one embodiment, rods according to the invention may be used as aerosol-generating substrates in heated smoking articles comprising a combustible heat source and an aerosol-generating substrate downstream of the combustible heat source.

For example, rods according to the invention may be used as aerosol-generating substrates in heated smoking articles of the type disclosed in WO-A-2009/022232, which comprise a combustible carbon-based heat source, an aerosol-generating substrate downstream of the combustible heat source, and a heat-conducting element around and in contact with a rear portion of the combustible carbon-based heat source and an adjacent front portion of the aerosol-generating substrate. However, it will be appreciated that rods according to the invention may also be used as aerosol-generating substrates in heated smoking articles comprising combustible heat sources having other constructions.

In another embodiment, rods according to the invention may be used as aerosol-generating substrates in heated smoking articles for use in electrically heated aerosol-generating systems in which the aerosol-generating substrate of the heated smoking article is heated by an electrical heat source.

For example, rods according to the invention may be used as aerosol-generating substrates in heated smoking articles of the type disclosed in EP-A-0 822 670.

Insertion and removal from an electrically heated aerosol-generating system of heated smoking articles including an aerosol-generating substrate comprising a rod comprising shreds of tobacco material tends to dislodge shreds of tobacco material from the rod. This can disadvantageously result in the need for more frequent cleaning of the electrical heat source and other parts of the electrically heated smoking system in order to remove the dislodged shreds.

In contrast, insertion and removal from an electrically heated aerosol-generating system of heated smoking articles including an aerosol-generating substrate comprising a rod comprising a gathered sheet of homogenised tobacco material advantageously does not result in dislodgement of tobacco material.

According to the invention there is further provided a filter for a smoking article, wherein the filter comprises a rod according to the invention.

Rods according to the invention may be used in filters for both lit-end smoking articles and heated smoking articles.

Rods according to the invention may used in filters comprising a single filter segment. Rods according to the invention may also be used in multi-component filters comprising two or more filter segments.

Filters comprising tobacco-containing filter segments are known in the art. For example, EP-A-1 889 550 discloses a multi-component filter for a smoking article comprising: a mouth end segment; a first flavour release segment comprising tobacco or other plant leaf upstream of the mouth end segment; and a second flavour release segment comprising filtration material and a flavourant upstream of the first flavour release segment. The resistance to draw of the second flavour release segment is greater than the resistance to draw of the first flavour release segment and the resistance to draw of the second flavour release segment is greater than the resistance to draw of mouth end segment.

In certain embodiments, rods according to the invention may be used as tobacco-containing filter segments in single or multi-component filters. For example, rods according to the invention may be used as a first flavor release segment in multi-component filters of the type disclosed in EP-A-1 889 550.

Filters comprising rods according to the invention may further comprise one or more filtration materials for the removal of particulate components, gaseous components or a combination thereof. Suitable filtration materials are known in the art and include, but are not limited to: fibrous filtration materials such as, for example, cellulose acetate tow and paper; adsorbents such as, for example, activated alumina, zeolites, molecular sieves and silica gel; and combinations thereof.

Alternatively or in addition, filters comprising rods according to the invention may further comprise one or more smoke or aerosol-modifying agents. Suitable smoke and aerosol-modifying agents are known in the art and include, but are not limited to: flavourants such as, for example, menthol.

Preferably, rods according to the invention are of substantially uniform cross-section.

Rods according to the invention may be produced having different dimensions depending upon their intended use.

For example, rods according to the invention may have a diameter of between about 5 mm and about 10 mm depending upon their intended use.

For example, rods according to the invention may have a length of between about 5 mm and about 150 mm depending upon their intended use.

In certain embodiments, rods according to the invention for use as rods of combustible smokable material in conventional lit-end smoking articles may have a length of between about 30 mm and about 140 mm.

In other embodiments, rods according to the invention for use as aerosol-generating substrates in heated smoking articles may have a length of between about 5 mm and about 20 mm.

In further embodiments, rods according to the invention for use in filters for conventional lit-end smoking articles and heated smoking articles may have a length of between about 5 mm and about 30 mm.

Rods according to the invention of a desired unit length may be produced by forming a rod according to the invention of multiple unit length and then cutting or otherwise dividing the rod of multiple unit length into multiple rods of the desired unit length.

For example, rods according to the invention having a length of about 15 mm for use as aerosol-generating substrates in heated smoking articles may be produced by forming a rod according to the invention having a length of about 150 mm and then severing the elongate rod into ten rods according to the invention having a length of about 15 mm.

Sheets of homogenised tobacco material for use in the invention may be formed by agglomerating particulate tobacco obtained by grinding or otherwise comminuting one or both of tobacco leaf lamina and tobacco leaf stems. Alternatively, or in addition, sheets of homogenised tobacco material for use in the invention tobacco may comprise one or more of tobacco dust, tobacco fines and other particulate tobacco by-products formed during, for example, the treating, handling and shipping of tobacco.

Where rods according to the invention are intended for use as aerosol-generating substrates in heated smoking articles, sheets of homogenised tobacco material for use in the invention preferably comprise particulate tobacco obtained by grinding or otherwise comminuting tobacco leaf lamina.

In certain embodiments, sheets of homogenised tobacco material for use in the invention may have a tobacco content of at least about 40% by weight on a dry weight basis or of at least about 50% by weight on a dry weight basis. In other embodiments, sheets of homogenised tobacco material for use in the invention may have a tobacco content of about 70% or more by weight on a dry weight basis. Where rods according to the invention are intended for use as aerosol-generating substrates in heated smoking articles, the use of sheets of homogenised tobacco material having high tobacco contents advantageously generates aerosols with enhanced tobacco flavour.

Sheets of homogenised tobacco material for use in the invention may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the invention may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the invention are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the invention are known in the art and include, but are not limited to: cellulose fibers; soft-wood fibres; hard-wood fibres; jute fibres and combinations thereof. Prior to inclusion in sheets of homogenised tobacco material for use in the invention, non-tobacco fibres may be treated by suitable processes known in the art including, but not limited to: mechanical pulping; refining; chemical pulping; bleaching; sulfate pulping; and combinations thereof.

Sheets of homogenised tobacco material for use in the invention should have sufficiently high tensile strength to survive being gathered to form rods according to the invention. In certain embodiments non-tobacco fibres may be included in sheets of homogenised tobacco material for use in the invention in order to achieve an appropriate tensile strength.

For example, homogenised sheets of tobacco material for use in the invention may comprise between about 1% and about 5% non-tobacco fibres by weight on a dry weight basis.

Suitable aerosol-formers and humectants for inclusion in sheets of homogenised tobacco material for use in the invention are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

In certain preferred embodiments, sheets of homogenised tobacco material for use in the invention comprising one or more aerosol-formers have an aerosol former content of greater than 5% on a dry weight basis.

In other preferred embodiments, sheets of homogenised tobacco material for use in the invention comprising one or more aerosol-formers have an aerosol former content of between about 5% and about 30% by weight on a dry weight basis.

For example, where rods according to the invention are intended for use as aerosol-generating substrates in heated smoking articles, sheets of homogenised tobacco material for use in the invention may have an aerosol former content of between about 5% and about 30% by weight on a dry weight basis.

It will be appreciated that the composition of sheets of homogenised tobacco material for use in the invention may be designed to comply with regulatory requirements.

A number of reconstitution processes for producing sheets of homogenised tobacco materials are known in the art. These include, but are not limited to: paper-making processes of the type described in, for example, U.S. Pat. No. 3,860,012; casting or 'cast leaf' processes of the type described in, for example, U.S. Pat. No. 5,724,998; dough reconstitution processes of the type described in, for example, U.S. Pat. No. 3,894,544; and extrusion processes of the type described in, for example, in GB-A-983,928. Typically, the densities of sheets of homogenised tobacco material produced by extrusion processes and dough reconstitution processes are greater than the densities of sheets of homogenised tobacco materials produced by casting processes.

Sheets of homogenised tobacco material for use in the invention are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

For example, in certain embodiments sheets of homogenised tobacco material for use in the invention may be formed from a slurry comprising particulate tobacco, guar gum, cellulose fibres and glycerine by a casting process.

Sheets of homogenised tobacco material for use in the invention may be textured using suitable known machinery for texturing filter tow, paper and other materials.

For example, sheets of homogenised tobacco material for use in the invention may be crimped using a crimping unit of the type described in CH-A-691156, which comprises a pair of rotatable crimping rollers. However, it will be appreciated that sheets of homogenised tobacco material for use in the invention may be textured using other suitable machinery and processes that deform or perforate the sheets of homogenised tobacco material.

Rods according to the invention may be produced from sheets of homogenised tobacco material having different dimensions depending upon their intended use.

Sheet of homogeneous tobacco material for use in the invention should be of sufficient width to be gathered to form a rod according to the invention.

Preferably, sheets of homogeneous tobacco material for use in the invention have a width of at least about 25 mm.

In certain embodiments sheets of homogeneous tobacco material for use in the invention may have a width of between about 25 mm and about 300 mm.

The resistance to draw of a rod according to the invention of a particular maximum transverse dimension is influenced by the width of the sheet of homogeneous tobacco material gathered to form the rod. The width of the sheet of homogenous tobacco material should be greater than the maximum transverse dimension of the rod.

Preferably, the width of the sheet of homogenised material is at least three times the maximum transverse dimension of the rod.

In certain embodiments, the width of the sheet of homogenised material may be at least five times the maximum transverse dimension of the rod. In other embodiments, the width of the sheet of homogenised material may be at least ten times the maximum transverse dimension of the rod.

Preferably, sheets of homogeneous tobacco material for use in the invention have a thickness of at least about 50 μm.

In certain embodiments, sheets of homogeneous tobacco material for use in the invention may have a thickness of between 50 μm and about 300 μm.

In certain embodiments, sheets of homogenised tobacco material for use in the invention may have a grammage 100 $g/m^2$ and about 300 $g/m^2$.

Rods according to the invention may comprise a gathered sheet of homogenised tobacco material circumscribed by a porous wrapper or a non-porous wrapper.

In certain embodiments, rods according to the invention may comprise a gathered sheet of homogenised tobacco material circumscribed by a paper wrapper.

Suitable paper wrappers for use in the invention are known in the art and include, but are not limited to: cigarette papers; and filter plug wraps.

In other embodiments, rods according to the invention may comprise a gathered sheet of homogenised tobacco material circumscribed by a non-paper wrapper.

Suitable non-paper wrappers for use in the invention are known in the art and include, but are not limited to: homogenised tobacco materials.

Rods according to the invention may be produced using conventional cigarette making and cigarette filter making machinery.

For example, rods comprising a gathered crimped sheet of homogeneous tobacco material according to the invention may be produced using machinery for forming filter rods comprising a gathered crimped sheet of paper of the type described in CH-A-691156.

According to the invention there is also provided a method of forming a rod according to the invention comprising the steps of: providing a continuous sheet of homogenised tobacco material comprising one or more aerosol-formers, wherein the sheet of homogenised tobacco material has an aerosol former content of greater than 5% on a dry weight basis; gathering the continuous sheet of homogenised tobacco material transversely relative to the longitudinal axis thereof; circumscribing the gathered continuous sheet of homogenised tobacco material with a wrapper to form a continuous rod; and severing the continuous rod into a plurality of discrete rods.

According to the invention there is further provided a method of forming a rod according to the invention comprising the steps of: providing a continuous sheet of homogenised tobacco material comprising one or more aerosol-formers, wherein the sheet of homogenised tobacco material has an aerosol former content of between 5% and 30% by weight on a dry weight basis; gathering the continuous sheet of homogenised tobacco material transversely relative to the longitudinal axis thereof; circumscribing the gathered continuous sheet of homogenised tobacco material with a wrapper to form a continuous rod; and severing the continuous rod into a plurality of discrete rods.

According to the invention there is further provided a method of forming a rod according to the invention comprising the steps of: providing a continuous sheet of homogenised tobacco material; gathering the continuous sheet of homogenised tobacco material transversely relative to the longitudinal axis thereof; incorporating a continuous element to which one or more additives have been applied into the gathered continuous sheet of homogenised tobacco material; circumscribing the gathered continuous sheet of homogenised tobacco material with a wrapper to form a continuous rod; and severing the continuous rod into a plurality of discrete rods.

The methods may further comprise texturing the continuous sheet of homogenised tobacco material. For example, the methods may comprise crimping, embossing, perforating or otherwise texturing the continuous sheet of homogenised tobacco material prior to gathering the continuous sheet of homogenised tobacco material transversely relative to the longitudinal axis thereof.

Preferably, the methods further comprise crimping the continuous sheet of homogenised tobacco material.

The methods may further comprise applying one or more additives to the continuous sheet of homogenised tobacco material. For example, the method may comprise spraying, dusting, sprinkling or otherwise applying one or more additives to the continuous sheet of homogenised tobacco material prior to gathering the continuous sheet of homogenised tobacco material transversely relative to the longitudinal axis thereof.

The one or more additives may be: one or more liquid additives; or one or more solid additives; or a combination of one or more liquid additives and one or more solid additives.

Suitable liquid and solid additives for use in the invention are known in the art and include, but are not limited to: flavourants, such as for example menthol; adsorbents, such as for example activated carbon; and botanical additives.

The one or more additives may be applied to substantially the entire continuous sheet of homogenised tobacco material. Alternatively, the one or more additives may be applied to selected regions or portions of the continuous sheet of homogenised tobacco material.

Where the methods also further comprise texturing the continuous sheet of homogenised tobacco material, the one or more additives may be applied to the continuous sheet of homogenised tobacco material prior to or after texturing the continuous sheet of homogenised tobacco material.

Preferably, the methods comprise applying the one or more additives to the continuous sheet of homogenised tobacco material after texturing the continuous sheet of homogenised tobacco material.

Alternatively or in addition to applying one or more additives to the continuous sheet of homogenised tobacco material, the methods may comprise incorporating a continuous element to which one or more additives have been applied into the gathered continuous sheet of homogenised tobacco material. For example, the methods may comprise incorporating a continuous element impregnated with a liquid flavourant into the gathered continuous sheet of homogenised tobacco material.

Suitable continuous elements for use in the invention are known in the art and include, but are not limited to: threads; yarns; tapes; filaments and other elongate elements.

Continuous elements for use in the invention may be formed from any suitable known materials capable of carrying one or more additives including, but not limited to: cotton; cellulose acetate; rayon; tobacco; and other textile or non-textile materials.

Continuous elements may be incorporated into the gathered continuous sheet of homogenised tobacco material using suitable known machinery for incorporating continuous elements into continuous rods of cellulose acetate tow and other filter materials such as described in, for example, U.S. Pat. Nos. 4,281,671 and 7,074,170.

The invention will be further described, by way of example only, with reference to the accompanying drawings in which.

Figure 1:
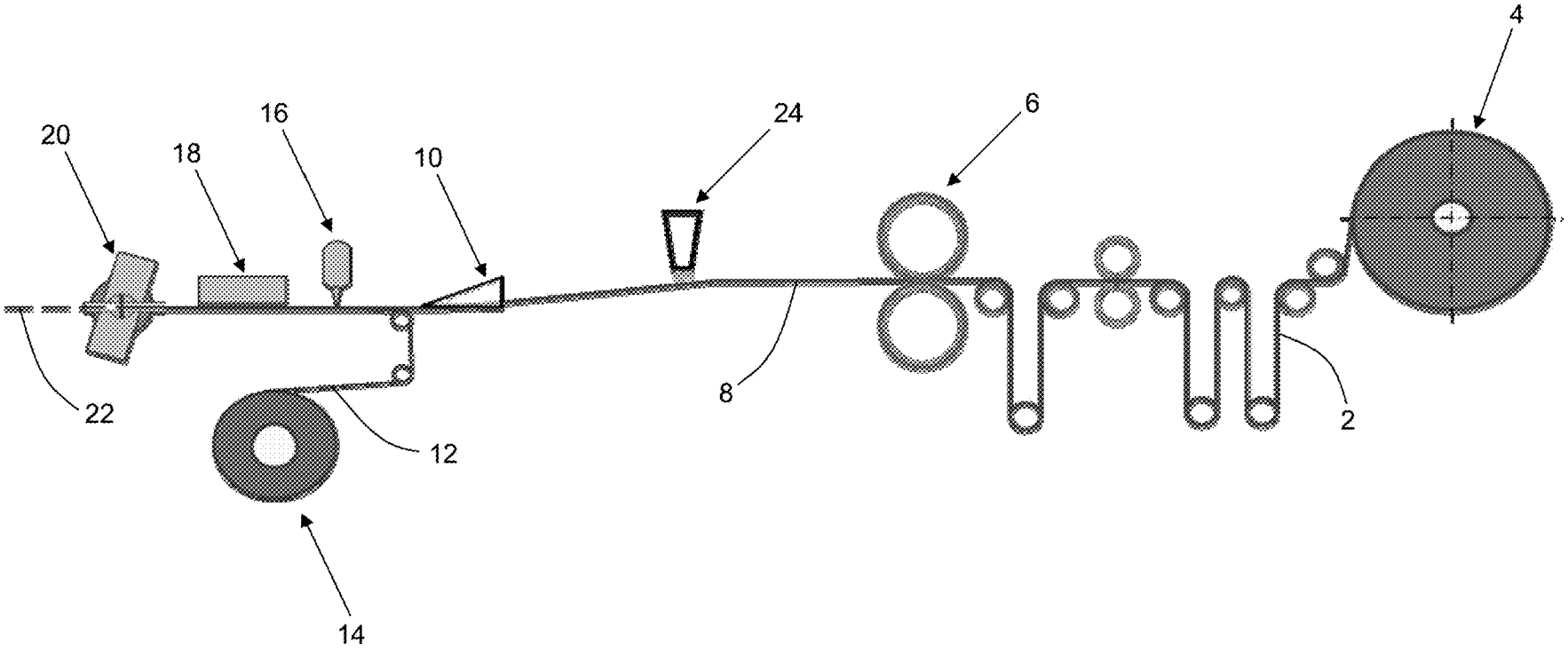
FIG. 1 shows a schematic cross-section of apparatus for forming a rod according to the invention.

The apparatus shown in FIG. 1 generally comprises: supply means for providing a continuous sheet of homogenised tobacco material; crimping means for crimping the continuous sheet of homogenised tobacco material; rod forming means for gathering the continuous crimped sheet of homogenised tobacco material and circumscribing the gathered continuous crimped sheet of homogenised tobacco material with a wrapper to form a continuous rod; and cutting means for severing the continuous rod into a plurality of discrete rods. The apparatus also comprises transport means for transporting the continuous sheet of homogenised tobacco material downstream through the apparatus from the supply means to the rod forming means via the crimping means.

As shown in FIG. 1, the supply means comprises a continuous sheet of homogenised tobacco material 2 mounted on a bobbin 4 and the crimping means comprises a pair of rotatable crimping rollers 6. In use, the continuous sheet of homogenised tobacco material 2 is drawn from the bobbin 4 and transported downstream to the pair of crimping rollers 6 by the transport mechanism via a series of guide and tensioning rollers. As the continuous sheet of homogenised tobacco material 2 is fed between the pair of crimping rollers 6, the crimping rollers engage and crimp the continuous sheet of homogenised tobacco material 2 to form a continuous crimped sheet of homogenised tobacco material 8 having a plurality of spaced-apart ridges or corrugations substantially parallel to the longitudinal axis of the sheet of homogenised tobacco material through the apparatus.

The continuous crimped sheet of homogenised tobacco material 8 is transported downstream from the pair of crimping rollers 6 to the rod forming means by the transport mechanism where it is fed through a converging funnel or horn 10. The converging funnel 10 gathers the continuous crimped sheet of homogenised tobacco material 8 transversely relative to the longitudinal axis of the sheet of homogenised tobacco material. The continuous crimped sheet of homogenised tobacco material 8 assumes a substantially cylindrical configuration as it passes through the converging funnel 10.

Upon exiting the converging funnel 10, the gathered continuous crimped sheet of homogenised tobacco material is wrapped in a continuous sheet of wrapping material 12. The continuous sheet of wrapping material is fed from a bobbin 14 and enveloped around the gathered continuous crimped sheet of homogenised tobacco material by an endless belt conveyor or garniture. As shown in FIG. 1, the rod forming means comprises an adhesive application means 16 that applies adhesive to one of the longitudinal edges of the continuous sheet of wrapping material, so that when the opposed longitudinal edges of the continuous sheet of wrapping material are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete rods of unit length or multiple unit length.

The apparatus shown in FIG. 1 further comprises an additive application means 24 located between the crimping means and the rod forming means for applying solid or liquid additives such as, for example, flavourants, to the continuous crimped sheet of homogenised tobacco material 8 before it is gathered transversely relative to the longitudinal axis thereof by the converging funnel 10.

In one alternative embodiment (not shown), the additive application means is located between the supply means and the crimping means for applying solid or liquid additives to the continuous sheet of homogenised tobacco material before it is crimped.

In another alternative embodiment (not shown), the additive application means is located adjacent to the converging funnel 10 of the rod forming means and is adapted to apply solid or liquid additives to the gathered continuous crimped sheet of homogenised tobacco material before it is wrapped in the continuous sheet of wrapping material 12.

In a further embodiment (not shown) the apparatus further comprises means located between the crimping means and the rod forming means for incorporating a continuous element to which one or more additives have been applied into the continuous crimped sheet of homogenised tobacco material 8 as it is gathered by the converging funnel 10.

EXAMPLE 1

Rods according to a first embodiment of the invention comprising a gathered crimped sheet of homogenised tobacco material circumscribed by a paper wrapper and having a length of 120 mm and diameters of between 6.9 mm and 7.2 mm were produced at rates of between 20 m/min and 25 m/min using apparatus of the type shown in FIG. 1. Continuous sheets of tobacco material produced by a casting process having a width of between 110 mm and 134 mm, a thickness of 120 μm to 260 μm, a grammage of between 167 g/m$^2$ and 201 g/m$^2$ and a moisture content of between 5% and 12% were used to form the rods.

The density of five rods according to the first embodiment of the invention was measured at positions between 10 mm and 110 mm along the length of the rods using a C$^2$ cigarette testing unit available from Cerulean, a trading name of Molins PLC of Milton Keynes, United Kingdom. The results of the density measurements are shown in FIG. 2.

For the purpose of comparison, the density of five rods of the same dimensions but comprising shreds of homogenised tobacco material circumscribed by a paper wrapper was also measured at positions between 10 mm and 110 mm along the length of the rods using standard techniques. The results of the density measurements are shown in FIG. 3.

Figure 2:
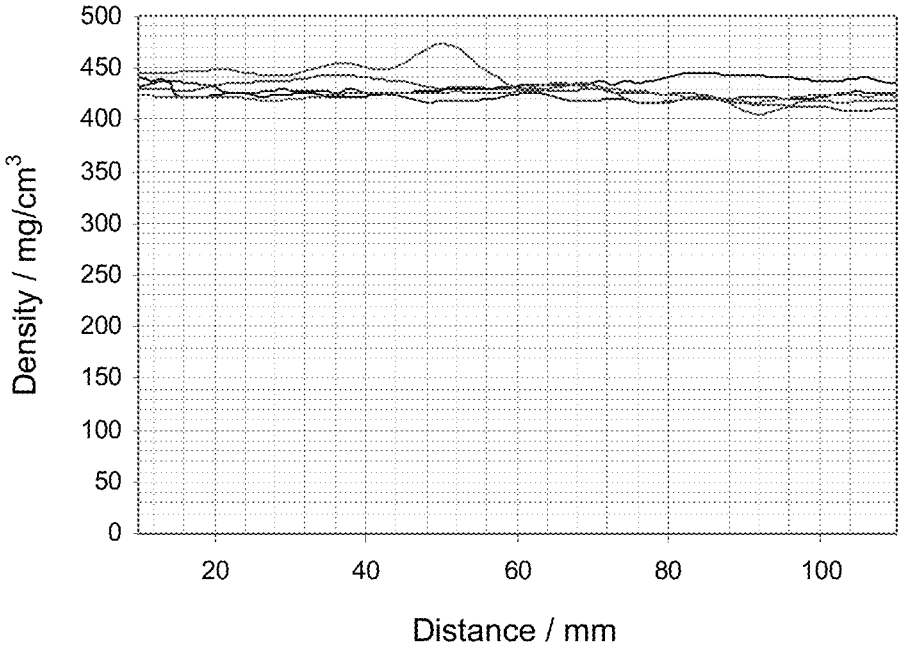
FIG. 2 shows the density of rods according to a first embodiment of the invention formed using the apparatus shown in FIG. 1.

As shown in FIG. 2, for the five rods according to the first embodiment of the invention the minimum density value is about 410 mg/cm$^3$, the maximum density value is about 450 mg/cm$^3$ and the average density value is about 430 mg/cm$^3$ with a standard deviation of about 9 mg/cm$^3$ and a coefficient of variation (CV) of about 2%.

Figure 3:
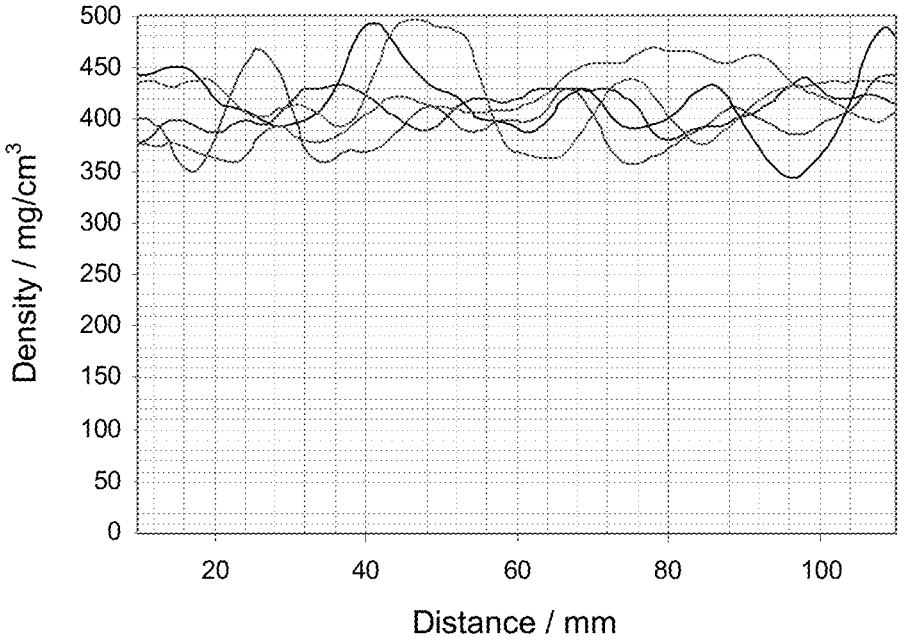
FIG. 3 shows the density of rods comprising shreds of tobacco material.

As shown in FIG. 3, for the five rods comprising shreds of homogenised tobacco material the minimum density value is about 360 mg/cm$^3$, the maximum density value is about 470 mg/cm$^3$ and the average density value is about 410 mg/cm$^3$ with a standard deviation of about 29 mg/cm$^3$ and a CV of about 7%.

As illustrated by the data presented in FIGS. 2 and 3, the rods according to the first embodiment of the invention advantageously exhibit more uniform densities than the rods comprising shreds of homogenised tobacco material.

EXAMPLE 2

Rods according to a second embodiment of the invention having a length of 12 mm and diameters of between 6.9 mm and 7.2 mm for use as aerosol-generating substrates in electrically heated smoking articles were produced by severing the rods according to the first embodiment of the invention produced in Example 1.

The invention claimed is:

1. A smoking article comprising an aerosol-generating substrate, wherein the aerosol-generating substrate is a rod comprising a gathered sheet of homogenised tobacco material circumscribed by a wrapper, wherein the gathered sheet of homogenised tobacco material comprises one or more aerosol-formers and has an aerosol-former content of greater than 5% on a dry weight basis, wherein the gathered sheet of homogenised tobacco material has a tobacco content of at least 70% by weight on a dry weight basis, wherein the gathered sheet of homogenised tobacco material comprises between 1% and 5% non-tobacco fibers by weight on a dry weight basis, wherein the rod has a length of between 5 mm and 20 mm, and wherein the gathered sheet of homogenised tobacco material has a grammage of between 100 g/m$^2$ and 300 g/m$^2$.

2. The smoking article according to claim 1, wherein the gathered sheet of homogenised tobacco material has a thickness of at least 50 μm.

3. The smoking article according to claim 1, wherein the gathered sheet of homogenised tobacco material has a thickness of between 120 μm and 260 μm.

4. The smoking article according to claim 1, wherein the gathered sheet of homogenised tobacco material of has a width of at least about 25 mm.

5. The smoking article according to claim 1, wherein the gathered sheet of homogenised tobacco material has a width of between 110 mm and 134 mm.

6. The smoking article according to claim 1, wherein the gathered sheet of homogenised tobacco material is convoluted.

7. The smoking article according to claim 1, wherein the gathered sheet of homogenised tobacco material is formed by a casting process.

8. The smoking article according to claim 1, wherein the gathered sheet of homogenised tobacco material is formed by agglomerating particulate tobacco.

9. The smoking article according to claim 1, wherein the smoking article is for an electrically heatable aerosol-generating system.

10. The smoking article according to claim 1, wherein the aerosol-generating substrate further comprises a thread, yarn, tape, or filament to which one or more additives have been applied, the thread, yarn, tape, or filament being incorporated into the gathered sheet of homogenised tobacco material.

11. The smoking article according to claim 1, wherein the one or more aerosol-formers comprises a polyhydric alcohol, an ester of a polyhydric alcohol, or an aliphatic ester of a mono-, di-, or poly-carboxylic acid.

12. The smoking article according to claim 1, wherein the one or more aerosol-formers comprises an aerosol-former selected from the list consisting of triethylene glycol, 1,3-butanediol, glycerine, glycerol monoacetate, glycerol diacetate, glycerol triacetate, dimethyl dodecanedioate, and dimethyl tetradecanedioate.

13. The smoking article according to claim 1, wherein the gathered sheet of homogenised tobacco material is formed by agglomerating particulate tobacco obtained by grinding or otherwise comminuting one or both of tobacco leaf lamina and tobacco leaf stems.

14. The smoking article according to claim 1, wherein the gathered sheet of homogenised tobacco material has a grammage of between 167 g/m$^2$ and 300 g/m$^2$.

* * * * *